US005651184A

United States Patent [19]

Tutty

[11] Patent Number: 5,651,184

[45] Date of Patent: Jul. 29, 1997

[54] CIRCUMSCRIBING APPARATUS

[76] Inventor: Larry Tutty, 3879 Happy Valley Road, Victoria, British Columbia, Canada, V8X 3W9

[21] Appl. No.: 433,049

[22] Filed: May 3, 1995

[51] Int. Cl.[6] ..... B43L 9/00

[52] U.S. Cl. ..... 33/21.1; 33/27.01; 33/42; 33/529

[58] Field of Search ..... 33/21.1, 21.3, 33/22, 23.01, 23.02, 27.01, 27.03, 27.04, 27.06, 41.1, 41.6, 42, 529, 645

[56] References Cited

U.S. PATENT DOCUMENTS

| | | | |
|---|---|---|---|
| 390,403 | 10/1888 | Sanborn | 33/42 |
| 1,781,634 | 11/1930 | Fenk | 33/529 |
| 1,792,393 | 2/1931 | Phillips | 33/42 |
| 1,860,653 | 5/1932 | Brown | 33/21.3 |
| 2,408,517 | 10/1946 | Howard | 33/21.3 |
| 2,844,874 | 7/1958 | Sury | 33/21.3 |
| 3,128,560 | 4/1964 | McKenzie | 33/529 |
| 3,827,153 | 8/1974 | Mitchell | 33/42 |
| 4,345,379 | 8/1982 | Pettingill, Jr. | 33/21 R |
| 4,393,594 | 7/1983 | Hoffman | 33/203.16 |
| 4,419,828 | 12/1983 | Farris | 33/175 |
| 4,553,305 | 11/1985 | Dearman | 29/272 |

FOREIGN PATENT DOCUMENTS

| | | | |
|---|---|---|---|
| 8441 | 3/1956 | Germany | 33/21.1 |

*Primary Examiner*—G. Bradley Bennett
*Attorney, Agent, or Firm*—Norman M. Cameron

[57] ABSTRACT

A circumscribing apparatus for marking a circular reference line about a cylindrical object has a first side. A first frame member has two spaced-apart guide members extending outwardly on the first side of the apparatus. The two guide members fall along a first straight line. A second frame member extends outwardly from the first frame member to a position on a second straight line which is perpendicular to the first line. A scribe is connected to the second member adjacent the position and has a marker extending outwardly on the first side of the apparatus. The apparatus can be used in conjunction with a wrap-around sleeve placed about the cylindrical object. The sleeve has a straight edge which extends about the object along a circular path when the sleeve is fitted. The apparatus is placed against the object with the two spaced-apart guide members contacting the edge. The marker is held against the object at a position spaced-apart outwardly from the edge. The apparatus is moved about the object so the projections stay in contact with the edge and the marker marks a circular line about the object.

6 Claims, 2 Drawing Sheets

CIRCUMSCRIBING APPARATUS

BACKGROUND OF THE INVENTION

This invention relates to apparatuses for circumscribing objects and, in particular, to apparatuses for circumscribing pipes to mark an even cut-off line thereabout.

It is often necessary to replace sections of pipe due to wear or damage. This applies to a wide range of pipe sizes from a few inches to several feet in diameter. However it is difficult to cut out the old section of pipe cleanly so that it can be replaced with a new length of pipe which can be welded in place easily by butt welding. The problem is that the existing welds tend to be irregular and distort the remaining ends of the pipe when the old section is removed.

Accordingly, after the old section of pipe is removed, a clean cut is made on the remaining sections of pipe to form circular, perpendicular ends. This allows a new length of pipe to be slipped into position with only a minor gap for butt welding.

The circular ends are first marked by running a scriber about the pipe. Conventionally a length of sheet metal having a straight edge, such as shim stock, is wrapped around each remaining end of the pipe so that the straight edge forms a circular line about the pipe. A circumscribing apparatus is then run around the pipe with the edge of the shim stock forming a guide. The circumscribing apparatus marks a circular line on the pipe at a distance closer to each end of the pipe than the sheet metal. In this way an even circular line can be marked on a distorted end of the pipe a distance from an undistorted portion where the shim stock is located. The circular line thus marked can be cut off evenly with a torch. The distance between the remaining sections of pipe can be measured and a new length of pipe accurately cut for fitting between them.

Different types of circumscribing apparatuses have been developed in the past. For example, U.S. Pat. No. 4,345,379 to Pettingill discloses a device for marking a tube at a pre-determined distance from the tube end.

U.S. Pat. No. 4,393,594 to Hoffman describes a collapsible scriber assembly for checking the radial and lateral run out of a wheel and tire assembly.

U.S. Pat. No. 4,419,828 to Farris describes an apparatus for establishing the junction contour for intersecting pipes.

A pipe fitter's scribing and spacing tool is disclosed in U.S. Pat. No. 4,553,305 to Dearman.

However, prior art devices of this general type suffer a number of significant disadvantages. In many cases they are not capable of circumscribing even circular lines about pipes having a wide range of diameters from a few inches to several feet. In other cases the apparatuses extend outwardly too far from the pipe such that they cannot move completely about the pipe due to interference from adjacent pipes or other objects. In other cases the apparatuses are relatively complex or expensive to produce.

SUMMARY OF THE INVENTION

Accordingly, it is an object of the invention to provide an apparatus and method for circumscribing pipes capable of being used on a wide variety of pipe diameters from a few inches to several feet.

It is also an object of the invention to provide an improved apparatus and method for circumscribing pipes which can be used on closely spaced pipes or pipes close to adjacent objects.

It is a further object of the invention to provide an improved method and apparatus for circumscribing pipes which is simple, robust in construction and economical to produce.

In accordance with these objects, there is provided a circumscribing apparatus for marking a circular reference line about a cylindrical object. The apparatus has a first side and includes a first frame member having two spaced-apart guide members extending outwardly on the first side of the apparatus. The two projections fall along a first line. There is provided a second frame member extending outwardly from the first frame member to a point on a second line which is perpendicular to the first line. A scribe is connected to the second member adjacent the point. The scribe also has a marker extending outwardly on the first side of the apparatus.

There is also provided according to another aspect of the invention a method of circumscribing a cylindrical object. The method includes fitting a wrap-around sleeve about the object. The sleeve has a straight edge which extends about the object along a circular path when the sleeve is fitted. A circumscribing apparatus is placed against the object. The apparatus has two spaced-apart projections contacting the edge. A member extends outwardly from the projections and has a marker adjacent the object at a position spaced-apart outwardly from the edge. The apparatus is moved about the object so the projections stay in contact with the edge and the marker marks a circular line about the object.

DESCRIPTION OF THE PREFERRED EMBODIMENTS

Figure 1:
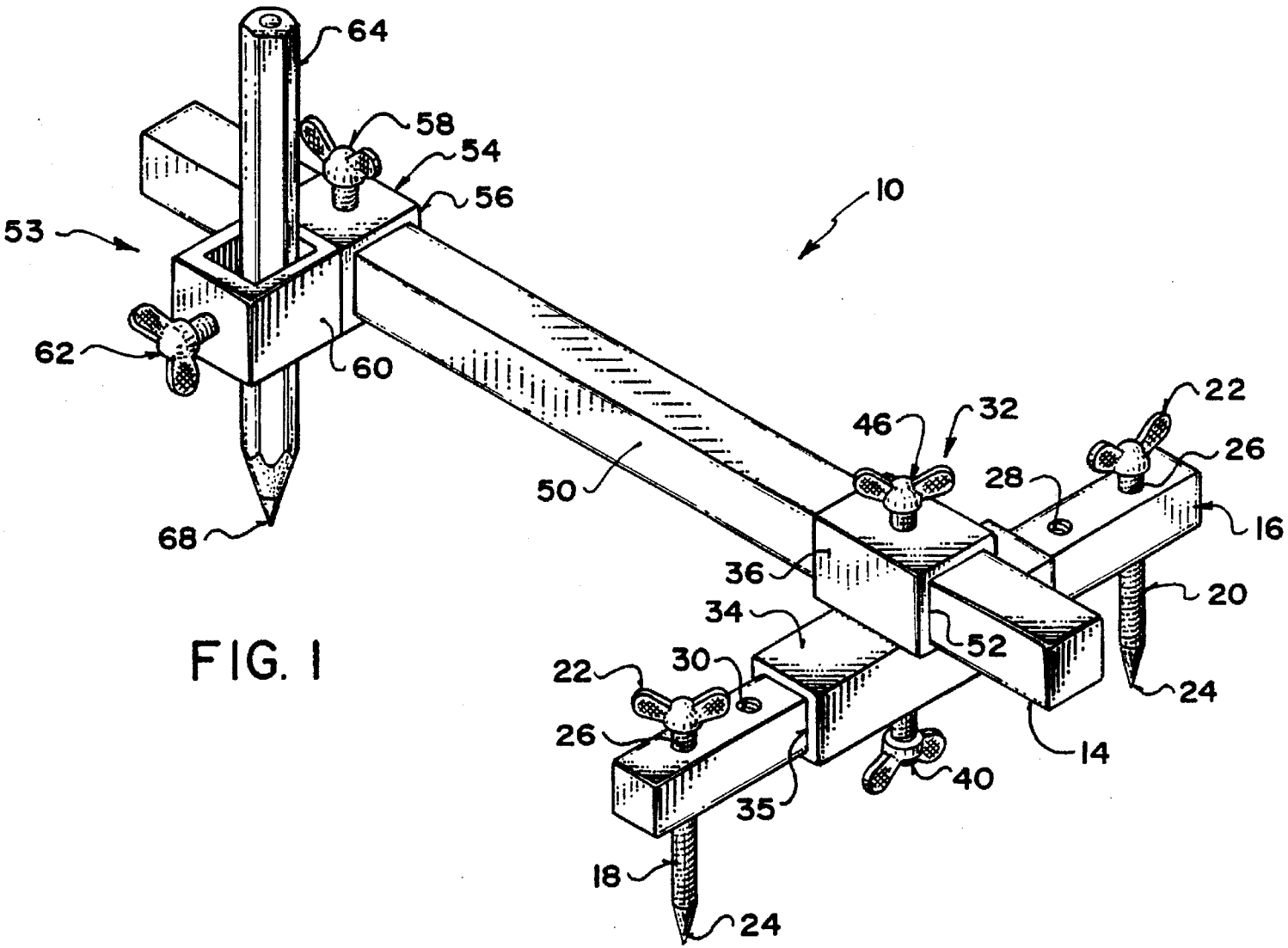
FIG. 1 is an isometric view of a circumscribing apparatus according to an embodiment of the invention.
Figure 2:
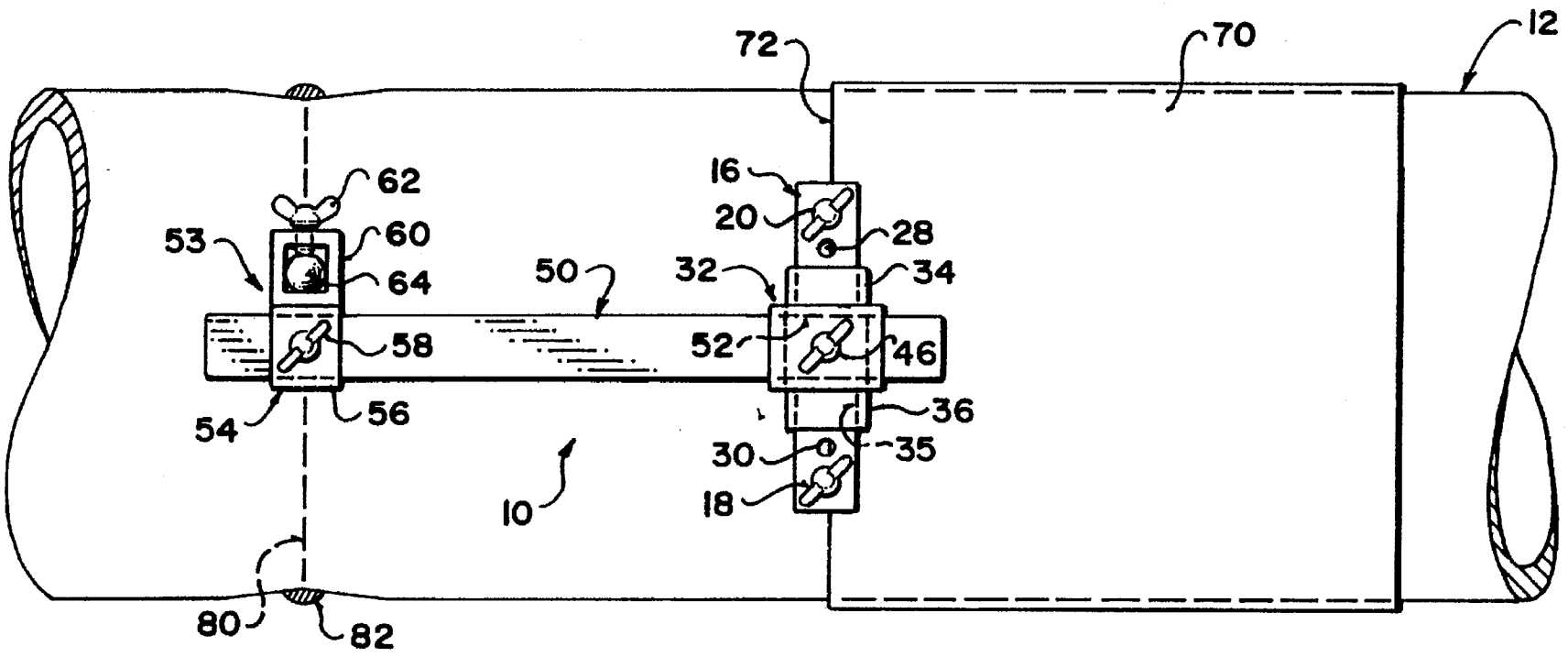
FIG. 2 is a side view of a length of pipe, shown in fragment, with a wrapped-around sleeve fitted thereabout and a circumscribing apparatus in contact with the sleeve.

Referring to the drawings, these show a circumscribing apparatus 10 intended for marking a circular reference line about a cylindrical object, such as pipe 12 in FIG. 2. The apparatus has a first side 14 which is shown at the bottom from the point of view of FIG. 1 and is against the pipe 12 in FIG. 2.

There is a first frame member 16 which in this example is a straight bar having a square cross-section although other shapes and configurations of members could be used in alternative embodiments. There are two spaced-apart guide members or projections 18 and 20 extending outwardly from the first frame member on the first side 14 of the apparatus. It may be seen that the two guide members fall along a first straight line which in this example is the center line of the frame member 16. The guide members in this example are male threaded thumb screws with grips 22 on outer ends thereof and point 24 on inner ends thereof. The guide members extend through threaded female apertures 26 in the first frame member. There are other female threaded apertures 28 and 30 which can alternatively receive the guide members to make the apparatus suitable for different diameters of pipe.

The apparatus includes a first clamp member 32 which in this example is made of two perpendicular lengths of tubing 34 and 36. Tubing 34 is square in section and has an inside longitudinal opening 35 with a cross-sectional extent slightly greater in size than the outside cross-sectional extent of the first frame member 16, thus allowing the first frame member to extend through the tubing 34 in a slidable manner.

There is first means for locking the first frame member in position with respect to opening 35 of the tubing 34. In the example the means is formed by another thumb screw 40 extending through a female threaded aperture in tubing 34 on side 14 of the apparatus. The thumb screw can be tightened to hold first frame member 16 fixedly in position.

The second tubular member 36 is generally similar to the first tubular member, but is perpendicular thereto and has another thumb screw 46. The member 36 is rigidly connected to member 34, by welding in this example. A second frame member 50 extends through opening 52 of tubing 36. In this embodiment the member 50 is similar in cross-sectional extent to member 16 and thereby is slidably received in the tubing. Thumb screw 46 can secure the second frame member 50 in any desired position with respect to the tubing 36 and accordingly the first clamp member 32. It may be appreciated that the frame members may be of different sizes and different shapes in alternative embodiments and could be connected together by other means.

There is a scriber 53 including second clamp member 54 with another length of tubing 56 similar to the tubing 34 and 36 in this particular embodiment. The second clamp member has another thumb screw 58 which can releasably engage the second frame member 50. Loosening the thumb screw allows the tubing 56 to move along the second frame member and tightening this thumb screw holds it in position. The second clamp member also includes another length of tubing 60 which is perpendicular to tubing 56 and has a thumb screw 62 for holding a marker 64 which in this case is a pencil. The pencil has a point 68 extending outwardly on the side 14 of the apparatus, forming a tripod-like arrangement with the guide members 18 and 20. It may be seen that the scriber is along a second straight line, defined by the center line of member 50, which is perpendicular to the line between members 18 and 20.

FIG. 2 shows the apparatus in use. A wrap-around sleeve 70 is placed about pipe 12. The sleeve has a straight edge 72 which forms a circular line about the pipe 12 when the wrap-around sleeve is in position as shown on an undistorted portion of pipe 12. After being wrapped-around the sleeve, a length of shim stock or the like can be held in place by tape or clamps. The apparatus 10 is then positioned as shown with the ends 24 of the guide members 18 and 20 against edge 72. As mentioned above, the guide members can be inserted through alternative apertures 28 and 30 in the first frame member 16 if desired depending upon the diameter of pipe involved. Thumb screw 40, shown in FIG. 1, is tightened to hold the first frame member 16 securely in position with respect to the first clamp member 32.

Thumb screw 46 on the tubing 36 is also tightened to hold the second frame member 50 securely in position with respect to tubing 36. Thumb screw 58 can be loosened to move the second clamp member 54 along the second frame member 50 so that the point 68 of marker 64 is at a position the desired distance from edge 72. Alternatively this can be done by loosening thumb screw 46 and moving the second frame member through the tubing 36.

The apparatus 10 is then moved about the pipe 12 with the guide members or projections 18 and 20 in contact with edge 72 of sleeve 70. Similarly the point 68 of the marker 64 is pressed against the pipe, thus marking a circular line 80 about the pipe as shown in FIG. 2. In this instance the line is about an existing weld 82 and adjacent heat shrunk area but the apparatus ensures that the line 80 is even.

After the circular line is marked about the pipe, the pipe can be cut off at this point with a torch and subsequently a grinder can be used to form an even circular edge perpendicular to the longitudinal axis of the pipe.

It will be understood by someone skilled in the art that many of the details described above are by of example only and are not intended to limit the scope of the invention which is to be interpreted with reference to the following claims.

What is claimed is:

1. A circumscribing apparatus for marking a circular reference line about a cylindrical object, the apparatus having a first side and comprising:

an elongated first frame member having two spaced-apart guide members extending outwardly on the first side of the apparatus, the two guide members being positioned along a first straight line, the guide members having pointed ends on the first side of the apparatus and being elongated, male threaded and parallel, the first frame member having female threaded apertures, the male threaded members engaging the female threaded apertures;

an elongated second frame member extending outwardly from the first member to a position spaced away from the first line;

a first clamp member having a first opening and a second opening, the first frame member and the second frame member being interconnected by the first clamp member, the first frame member extending through the first opening of the first clamp member, the first clamp member including a thumb screw for locking the first frame member in a position with respect to the first opening, the second frame member extending through the second opening of the first clamp member, the first clamp member include a thumb screw for locking the second frame member in a position with respect to the second opening; and a scribe connected to the second member adjacent the position and having a marker extending outwardly on the first side of the apparatus.

2. An apparatus as claimed in claim 1, wherein the first clamp member includes two perpendicular lengths of tubing rigidly connected together, the openings as being longitudinal openings in the tubing.

3. An apparatus as claimed in claim 2, wherein the scribe includes a second clamp member.

4. An apparatus as claimed in claim 3, wherein the second clamp member includes a third length of tubing, the second frame member extending through a longitudinal opening in the third length of tubing.

5. An apparatus as claimed in claim 4, wherein the second clamp member includes a thumb screw extending through the third length of tubing and releasably engaging the second frame member.

6. An apparatus as claimed in claim 5, wherein the scribe is at a position on a second straight line which is perpendicular to the first straight line and the second clamp member includes a thumb screw releasably engaging the marker.

* * * * *